United States Patent [19]

Nicodemus et al.

[11] Patent Number: 4,781,537

[45] Date of Patent: Nov. 1, 1988

[54] VARIABLE FLOW RATE SYSTEM FOR HYDROKINETIC AMPLIFIER

[75] Inventors: Carl D. Nicodemus, Mumford; Blake T. Nicodemus, Perry, both of N.Y.

[73] Assignee: Helios Research Corp., Mumford, N.Y.

[21] Appl. No.: 151,821

[22] Filed: Feb. 3, 1988

Related U.S. Application Data

[63] Continuation-in-part of Ser. No. 24,589, Mar. 11, 1987, abandoned.

[51] Int. Cl.[4] ..... F04F 5/00; F04F 5/48; B05B 7/00

[52] U.S. Cl. ..... 417/54; 417/173; 417/174; 417/185; 417/190; 417/197; 417/198; 239/443

[58] Field of Search ..... 417/54, 55, 151, 167, 417/173, 174, 182, 185, 190, 197, 198; 239/443

[56] References Cited

U.S. PATENT DOCUMENTS

| | | | |
|---|---|---|---|
| 1,026,399 | 5/1912 | Koerting | 417/174 |
| 1,215,321 | 2/1917 | Leblanc | 417/167 |
| 1,328,139 | 1/1920 | Elliott, Jr. | 417/54 |
| 1,568,466 | 1/1926 | Ostermann | 417/187 |
| 2,107,340 | 2/1938 | Pedrick | 417/174 |
| 2,207,390 | 7/1940 | White | 417/174 X |
| 2,397,870 | 4/1946 | Kneass, Jr. | 417/173 X |
| 3,829,024 | 8/1974 | Heden | 239/443 X |
| 3,986,523 | 10/1976 | Pacht | 230/443 X |
| 4,413,785 | 11/1983 | Engelbert et al. | 239/443 |
| 4,569,635 | 2/1986 | Nicodemus | 417/197 X |
| 4,673,335 | 6/1987 | Nicodemus | 417/174 X |

FOREIGN PATENT DOCUMENTS

| | | | |
|---|---|---|---|
| 3005653 | 8/1981 | Fed. Rep. of Germany | 417/173 |
| 972553 | 8/1950 | France | 417/174 |

*Primary Examiner*—Carlton R. Croyle
*Assistant Examiner*—Paul F. Neils
*Attorney, Agent, or Firm*—Stonebraker, Shepard & Stephens

[57] ABSTRACT

A hydrokinetic amplifier 10 having a primary liquid input formed into a primary liquid jet surrounded by a motivating vapor that transfers vapor momentum to the primary liquid jet and accelerates the primary liquid jet through a minimum cross-sectional area 20 upstream of a diffuser is provided with a secondary inlet that admits a secondary fluid to merge with the primary liquid jet in a diffuser 16 beyond the minimum cross-sectional area. Without varying the primary inflows of liquid and vapor, the secondary flow varies inversely with the fluid flow resistance of the output load; and this can be used to vary the volume, pressure, and temperature of the output. The product of the pressure and volume of the combined flows can exceed the product of the pressure and volume of the primary flow, and change in the load resistance can be used to turn the secondary flow on and off for adding a material to the primary flow.

23 Claims, 4 Drawing Sheets

VARIABLE FLOW RATE SYSTEM FOR HYDROKINETIC AMPLIFIER

RELATED APPLICATIONS

This application is a Continuation-In-Part of our parent application Ser. No. 024,589, filed 11 Mar. 1987, entitled VARIABLE FLOW RATE SYSTEM FOR HYDROKINETIC AMPLIFIER, and abandoned upon the filing of this Continuation-In-Part application.

BACKGROUND

Injectors and hydrokinetic amplifiers, such as shown in U.S. Pat. No. 4,569,635, are constant flow devices that can operate between minimum and maximum pressures at a single flow rate. To operate near maximum pressure requires careful matching of the output pressure resistance with the pressure and flow capability of the hydrokinetic amplifier. If vapor pressure then drops, which can easily happen in an industrial environment placing other demands on the same vapor supply, the amplifier has insufficient motivating vapor to meet the output pressure resistance and stalls. This stops the outflow, dumps the inflow, and requires a restart. A sudden increase in liquid supply pressure can also cause a stall by supplying more liquid than the available vapor can accelerate through the output of the amplifier. Since fluctuations in liquid and vapor supply pressures are bound to occur, hydrokinetic amplifiers are usually designed to operate with less than optimum inputs, but this has the disadvantage of reducing the output performance, even when optimum inputs are available. These limitations make injectors and hydrokinetic amplifiers more difficult to match with output pressure resistances than centrifugal pumps, for example, which can vary the flow rate, as well as the pressure, of their outputs.

We have discovered a way of providing a hydrokinetic amplifier with a variable output flow rate, allowing it to better accommodate variations in inflow rates and in output pressure resistances. Our way of varying the outflow rate from a hydrokinetic amplifier surprisingly improves the efficiency of its diffuser so that hydrokinetic amplifiers provided with our invention can increase the product of the pressure and volume of their output. Our variable outflow rate can also be used for controlling the temperature of the output or the proportion of two flows combined into the output. This includes starting and stopping the flow of an additive material, such as a detergent or foaming agent, that can merge with the output flow, when desired by an operator. Our invention accomplishes improved efficiency and a variable output flow rate in a simple and inexpensive way that makes hydrokinetic amplifiers more versatile without adding significantly to their cost.

SUMMARY OF THE INVENTION

Our invention applies to an injector or hydrokinetic amplifier having a primary liquid input formed into a primary liquid jet surrounded by a motivating vapor that transfers vapor momentum to the primary liquid jet and accelerates the primary liquid jet through a minimum cross-sectional area upstream of a diffuser arranged beyond the minimum cross-sectional area. We admit a secondary fluid to merge with the primary liquid jet in a region beyond the minimum cross-sectional area, so that the secondary fluid flow and the primary liquid jet combine and proceed into the diffuser. We then can vary the flow rate of the output from the hydrokinetic amplifier by varying the fluid flow resistance of the load to which the output flow is delivered. Changing the fluid flow resistance of the load inversely varies both the rate of inflow of the secondary fluid and the rate of outflow from the diffuser to the load.

Liquid supplied to the hydrokinetic amplifier can be drawn from downstream of the diffuser and fed back to the primary liquid input. If the secondary fluid is a cooler liquid, this can be used to cool the primary liquid feedback in a counter current heat exchanger. The secondary fluid can also be a liquid warmer than the primary liquid jet; and if the secondary fluid has a different temperature from the primary jet, the proportions of the two flows can be controlled to adjust the temperature of the outflow. We have found that the product of pressure and volume (PV) of the combined primary and secondary flows can exceed the product of the pressure and volume of the primary liquid flow through the minimum cross-sectional area. We have also found that the additional flow through the secondary inlet varies inversely with the output pressure resistance to the combined primary and secondary flows. Moreover, we have discovered that the presence or absence of the secondary fluid in the outflow can be controlled by varying the fluid flow resistance of the load, to shut off the secondary fluid flow when the load resistance is high and to admit the secondary fluid flow as an additive to the primary flow by lowering the fluid flow resistance of the load.

DRAWINGS

DETAILED DESCRIPTION

Figure 1:
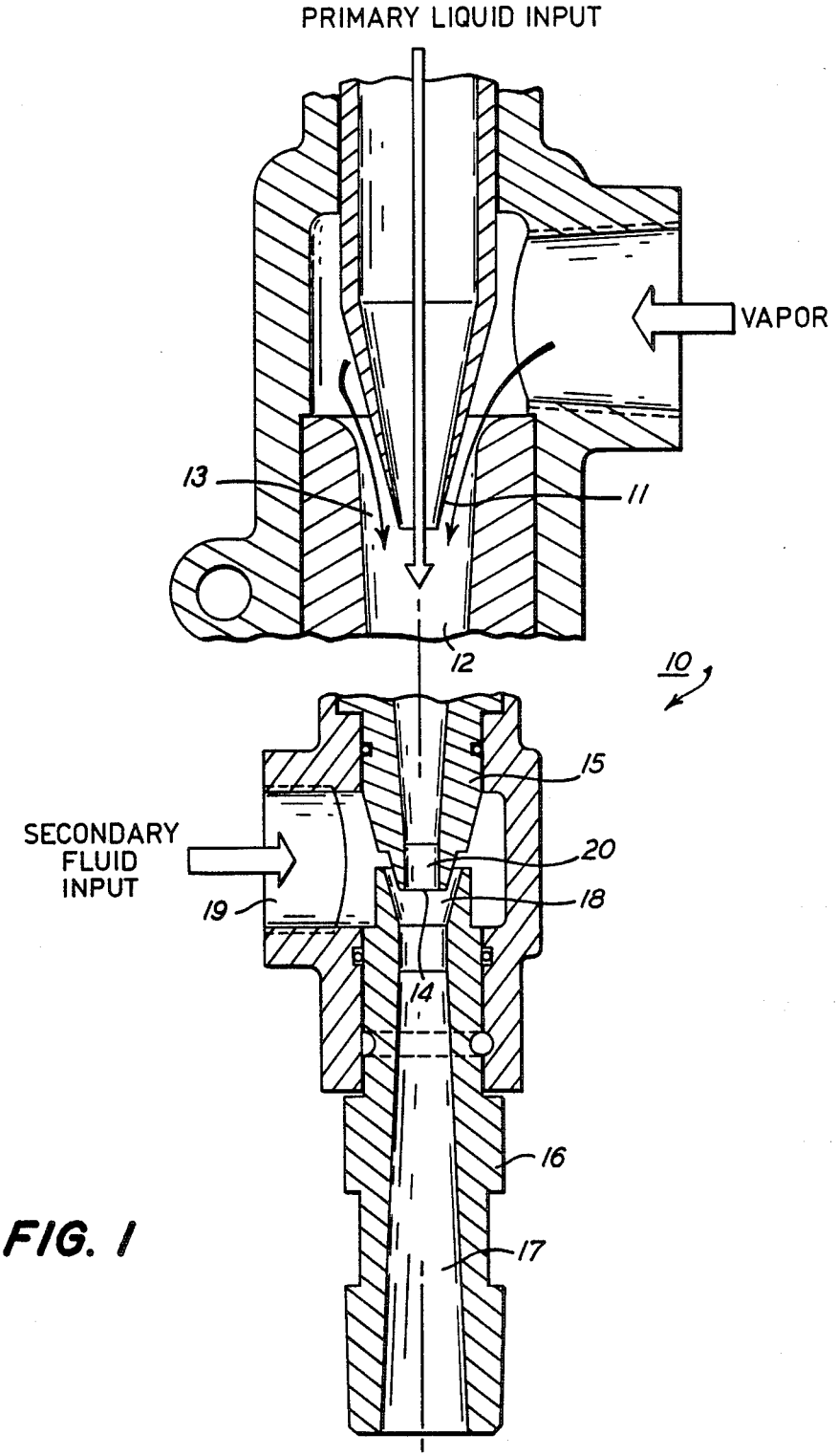
FIG. 1 is a partially cutaway, cross-sectional view of a preferred embodiment of a hydrokinetic amplifier having a secondary inlet according to the invention.

We vary the outflow rate of a hydrokinetic amplifier by admitting a secondary fluid to merge with the primary liquid flow through the hydrokinetic amplifier, and we have a preferred way of accomplishing this merger, as best shown in FIG. 1. A primary liquid input enters hydrokinetic amplifier 10 through a liquid input nozzle 11 to form a primary liquid jet directed into mixing chamber 12, which is partially cut away to shorten the view. Vapor that surrounds and accelerates the primary liquid jet enters hydrokinetic amplifier 10 via vapor nozzle 13 so that the vapor merges with the primary liquid jet and accelerates it through nozzle 15 and through minimum cross-sectional area 20, sometimes called "R area". The passageway through minimum cross-sectional area 20 can extend axially for a distance as illustrated or can be reduced axially to a single line within nozzle 15. At or beyond R area 20, passageway 15 terminates at end 14 to discharge and direct the primary liquid jet toward diffuser 16, having a diverging region 17 downstream of R area 20. Diffuser 16 also has a converging region 18 that surrounds and overlaps the terminated end 14 of passageway 15 and is spaced around passageway 15 to provide a secondary inlet.

Since the primary liquid jet departing from the terminated end 14 of nozzle passageway 15 has been accelerated to a high velocity by the surrounding vapor in mixing chamber 12 and nozzle 15, it establishes a low pressure region within secondary inlet 18. This draws in secondary fluid through opening 19 to flow along the conical path established by secondary inlet 18 to be guided in the same direction as the primary jet and to merge with the primary jet enroute to the diverging region 17 of diffuser 16. This directs the momentum of the secondary inflow to combine additively with the momentum of the primary jet so that the combined primary and secondary flows proceed into diffuser 16 where diverging region 17 converts their velocity to pressure.

We prefer that secondary inlet 18 be near the upstream end of diffuser 16 as illustrated and that passageway 15 terminate at end 14 before diverging from R area 20. Passageway 15 can also diverge from R area 20 before discharging into a secondary inlet located further downstream. The secondary inlet, besides surrounding the primary liquid jet, can also be formed as a plurality of openings into passageway 15; and this can be especially effective if passageway 15 is diverging from R area 20.

Previous suggestions have been made for inflowing of fluid into a hydrokinetic amplifier in a region above R area 20, and this has been done in several ways. Any fluid merging with the primary liquid jet above R area 20 must pass through R area 20, along with the primary liquid jet, and this limits the inflow rate of any secondary fluid. Also, above R area 20, the motivating vapor is accelerating and condensing in the primary liquid jet, so that merging a secondary fluid with the primary jet and its surrounding vapor may affect the vapor to liquid momentum transfer.

We have found that locating secondary inlet 18 beyond R area 20 has several advantages. The secondary inflow rate is not limited by the size of R area 20 and does not affect the acceleration of the primary liquid jet through R area 20. Also, the temperature of the secondary fluid inflow does not affect the condensation of the primary motivating vapor, which occurs primarily above R area 20.

When the secondary inflow is liquid, converging region 18 should be shaped so that the annular inflow region upstream of terminated end 14 converges for a nozzle effect accelerating the liquid inflow between the outside of passageway 15 and the inside of converging region 18. This speeds up the secondary liquid flow and aims it in the same direction as the primary jet so that the momentum of the secondary liquid is added to the momentum of the primary liquid jet. If the secondary inflow is a gas or vapor, then the annular inflow region between the outside of passageway 15 and the inside of conical region 18 should diverge or enlarge. This provides an expanding inflow region that accelerates a gas or vapor to combine its momentum with that of the primary liquid jet.

Assuming constant supplies of primary input of liquid and vapor, we have found that different output pressure resistances control the flow rate of a secondary fluid merged with the primary. For example, if the output pressure resistance is near the maximum output pressure produceable under particular operating conditions for a hydrokinetic amplifier 10, this pressure resistance produces a pressure balance in an upper region of diffuser 16 that restricts secondary inflow to little or nothing. As output pressure resistance drops, without change in the operating conditions for hydrokinetic amplifier 10, the pressure balance region within diffuser 16 moves downward toward its output end and accommodates an increasing inflow of secondary fluid. Although the output pressure of the flow generally reduces as secondary inflow increases, we have found that the product of the pressure and volume of an outflow including a secondary fluid is generally larger than the pressure and volume product of the primary liquid flow through minimum cross sectional area 20.

Figure 3:
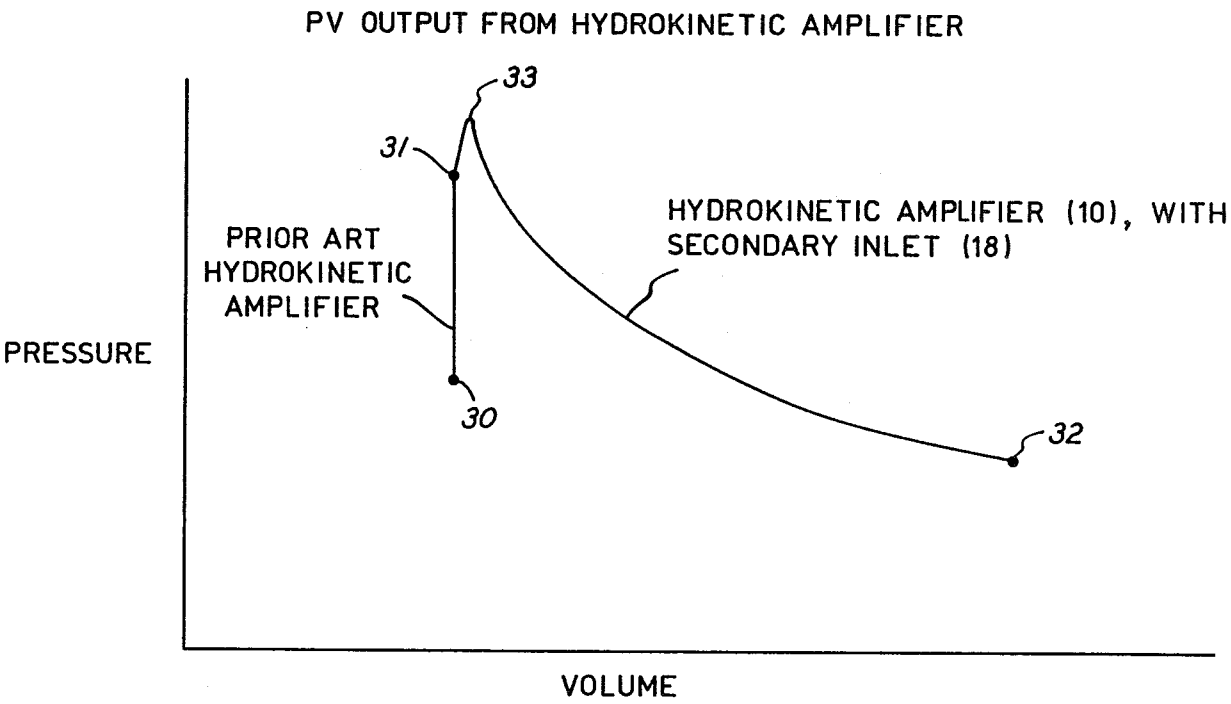
FIG. 3 is a diagram of the performance of a hydrokinetic amplifier according to the invention compared with a prior art hydrokinetic amplifier.

The graph of FIG. 3 illustrates this. A prior art hydrokinetic amplifier having no secondary fluid inlet operates at a constant volume within range of pressures from points 30 to 31. The PV for a hydrokinetic amplifier 10 having secondary inlet 18 includes a variable volume up to a maximum possible flow at point 32 and pressures ranging slightly upward from point 31 to a peak 33, where a small inflow of secondary fluid occurs, and downward from peak 33 through a range of diminishing pressures and increasing flow rates.

The PV of a combined flow is normally no greater than the PV of a primary flow, as evidenced in a jet pump, for example, but we have observed higher PV's for combined flows from hydrokinetic amplifier 10 than the PV of the primary flow through minimum cross-sectional area 20. Although we are not certain of the reason for this, it appears that admitting secondary flow to the upper region of diffuser 16 makes the diffuser more efficient than if the primary flow alone is flowing through the diffuser. Increased diffuser efficiency may arise from lack of vapor passing into the diffuser, lack of cavitation in the diffuser, and other factors; but the surprising increase in PV output when secondary liquid is merged with the primary is well substantiated in our work.

One of the advantages of admitting a secondary liquid into inlet 18 is to allow hydrokinetic amplifier 10 to provide the maximum flow rate possible for a range of output pressure resistances. This makes amplifier 10 more versatile and more easily matched with output pressure resistances, which can also be varied during operation. In using amplifier 10 for powering a spray bar, for example, the total area of the openings of nozzles along the spray bar can be changed to vary the output pressure resistance; and throughout a range of such variation, amplifier 10 will provide a varying liquid flow rate up to maximum possible pressure. If the nozzle area is made larger, the delivery pressure reduces, but the flow rate increases. If the nozzle area is reduced, the delivery pressure increases, and the flow rate reduces. Previous hydrokinetic amplifiers with fixed flow rates could operate at varying output pressures, but could not increase the flow rate if the output pressure resistance dropped. The secondary inlet thus makes hydrokinetic amplifier 10 more versatile and more like a centrifugal pump whose output pressure and volume can both vary.

Changes in output flow rates, inversely to variation in fluid flow resistance of a load, also occur in our hydrokinetic amplifier without variation in flow rates or pressures of the primary liquid and vapor inputs. Thus, our variable flow rate hydrokinetic amplifier can be installed to operate with whatever liquid and vapor pressures are available in an industrial environment and can use these to produce a maximum outflow to a load, which can vary in its fluid flow resistance. This allows considerable versatility in varying the load, which can receive the maximum fluid flow for any resistance, while the hydrokinetic amplifier efficiently combines its primary inputs and compensates for load resistance by automatically varying the flow rate of the secondary input.

Besides using secondary liquid inflow to vary the output flow rate of hydrokinetic amplifier 10, a secondary liquid can also vary the temperature of the output flow. The primary liquid input to a hydrokinetic amplifier must be cool enough relative to the motivating vapor to condense the vapor in the primary liquid jet and thereby transfer the vapor momentum to the liquid, but there is no limitation on the temperature of a secondary liquid combined with the primary liquid jet at secondary inlet 18. A secondary liquid inflow cooler than the primary liquid jet flowing through R area 20 can reduce and regulate the temperature of the combined outflow. A primary flow of 200° F., for example, can drive an outflow at 150° F., if desired, by combining a suitable proportion of a secondary liquid inflow at a lower temperature. The outflow temperature can be controlled, as shown schematically in FIG. 2, by sensing the temperature of the outflow from diffuser 16 and using that to control a valve in the secondary fluid inlet.

The ability of the secondary inlet to accept different temperature liquids also allows it to accept secondary liquid or vapor hotter than the primary liquid jet. This can be used to recirculate hot washing water, for example, that could not be fed at high temperature into the primary liquid input. Cleaning chemicals, gases, and practically everything flowable can be directed into the secondary inlet to accommodate a wide variety of processes, such as evaporation, distillation, refrigeration, and others. Since a hydrokinetic amplifier can develop many times the output pressure of boiler vapor powering it, hydrokinetic amplifier 10 can be operated for feeding hot return water to a boiler via secondary inlet 18 while amplifier 10 is supplied with cool make-up water input to the primary inlet. Having two liquid inflows to hydrokinetic amplifier 10 allows control of proportional flow rates by varying the secondary inflow relative to the primary. The ability to increase the outflow rate by a large addition of secondary liquid allows amplifier 10 to pump cold water with only a minor increase in liquid output temperature.

Vapor as the secondary fluid inflow also has several important uses, including evaporation and distillation processes. The motivating vapor accelerating the primary liquid jet through R area 20 can be evaporated from a material such as maple sap or tomato slurry, and the evaporation pressure can be subatmospheric. Secondary inlet 18 can be used to entrain more of the evaporated vapor into diffuser 16. The entrained vapor can be accelerated toward the diffuser in a diverging inlet 18, to add the vapor momentum to the liquid flow. This expands and cools the vapor somewhat, as the merged liquid and vapor proceed toward diverging region 17, where the velocity reduces and converts to pressure that condenses the vapor. This occurs beyond inlet 18 where it does not cause back pressure resistance to inflowing vapor. The ability of secondary inlet 18 to entrain additional vapor increases the capability of hydrokinetic amplifier 10 for evaporation. The additional vapor entrained at secondary inlet 18 increases the outflow temperature, but this can be used to advantage in evaporation processes by using multistage operation, preheaters, and other heat exchangers. Vapor condensed in hydrokinetic amplifier 10 can also be valuable as a distillate, and the distillation output can be increased in a similar way by admitting additional vapor through secondary inlet 18. This also applies to refrigeration and heat processes, where amplifier 10 can condense vapors such as ammonia flowing in refrigeration circuits.

Figure 2:
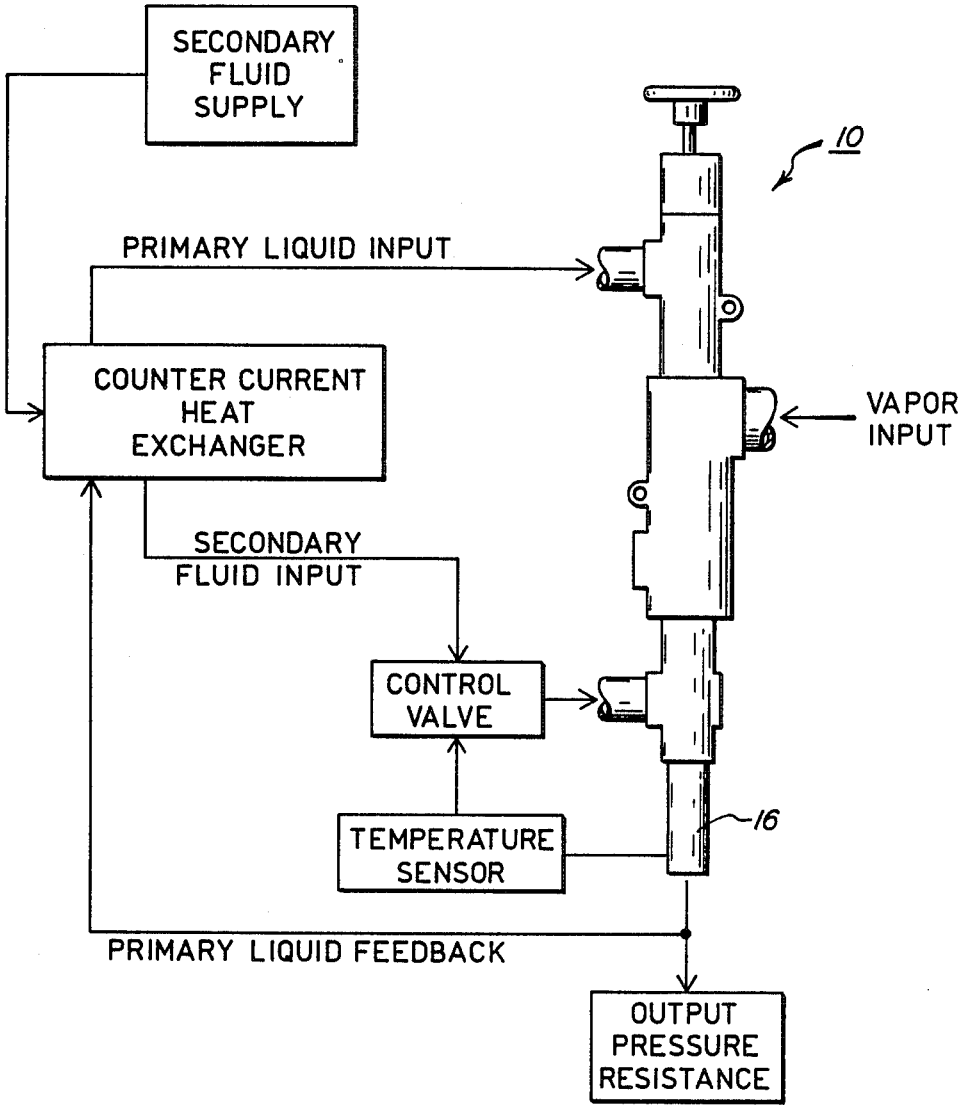
FIG. 2 is a schematic diagram of preferred ways of operating a hydrokinetic amplifier according to the invention.

The primary liquid input can be derived from the output of hydrokinetic amplifier 10, downstream of diffuser 16, as schematically shown in FIG. 2. If the secondary fluid input is liquid, it can cool the primary feedback liquid in a counter current heat exchanger as the feedback liquid heads for the primary inlet and the secondary liquid heads for secondary inlet 18. Since feeding back of pressurized output liquid to the primary liquid input speeds up the primary liquid jet and in turn increases the accelerated jet velocity and the output pressure, a feedback primary can give hydrokinetic amplifier 10 a very high pressure capability. This can increase the operating pressure range of amplifier 10 from very high pressures against very high output pressure resistances, down to much lower pressures and much higher flow rates augmented by a secondary liquid flow. Hydrokinetic amplifiers operated in a feedback mode have produced pressures as high as 3,000 psi, with no known upper limit, so that depending on the pressure strength of the piping and the maximum pressure resistance of the output, the operating range of amplifier 10 can be extended considerably by operating in the feedback mode as shown in FIG. 2.

The sensing of outflow temperature and the control of secondary input, as shown in FIG. 2, can occur for secondary flows of either liquid or vapor and does not require the feedback mode that is also illustrated in FIG. 2. Also, feedback and single pass operation can be used with a variety of controls for different liquids and vapors to achieve a wide range of effects, all taking advantage of secondary input.

Figure 4:
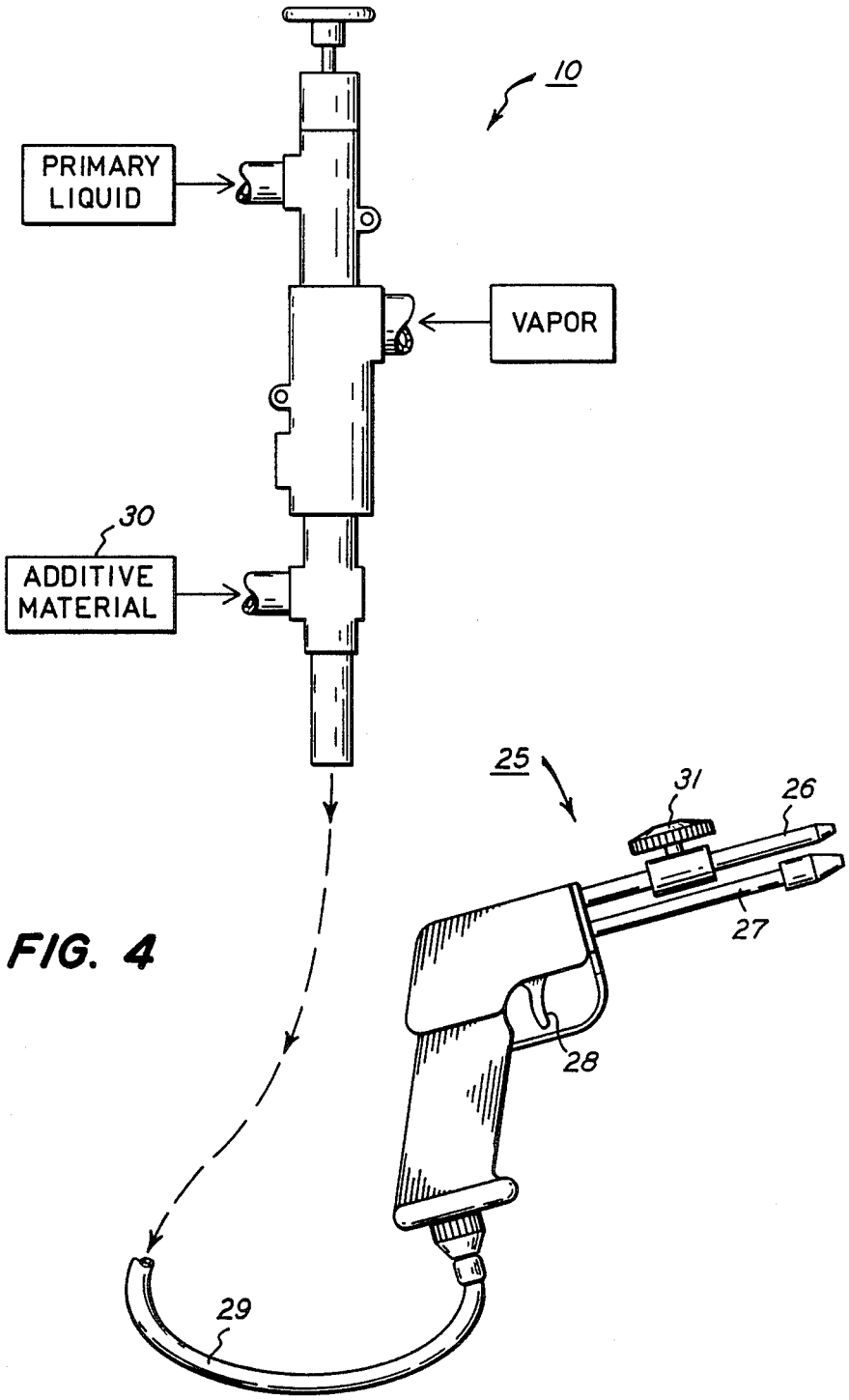
FIG. 4 is a partially schematic view of a hydrokinetic amplifier provided with a secondary fluid inflow controlled by varying the fluid flow resistance of a load represented by a cleaning gun.

The automatic effect of a varying load resistance on the inflow of the secondary fluid can be exploited in several ways, one of which is schematically illustrated in FIG. 4. A cleaning gun 25 having double barrels 26 and 27 and an operating trigger 28 can be connected by a line 29 to the output of hydrokinetic amplifier 10. This is supplied with a primary liquid and vapor in the usual way; and its secondary input is connected to a supply of an additive material 30, which can be a detergent or foaming agent, for example. A valve 31 in gun barrel 26 can be opened or closed by the operator to make gun 25 operate on either single barrel 27 or double barrels 26 and 27. In the single-barreled mode, delivering an output only through barrel 27, gun 25 provides a high resistance load to the output of hydrokinetic amplifier 10; and this automatically shuts off any inflow of additive material 30 into the secondary input. The outflow through single barrel 27 is then hot washing water.

If the operator opens valve 31, gun 25 delivers a flow through both barrels 26 and 27 and, in this double-barreled mode, presents a low fluid flow resistance load to hydrokinetic amplifier 10. This automatically causes an inflow of additive material 30 into the secondary input. At gun 25, the primary and secondary flows have become merged and are delivered from both barrels 26 and 27 to apply a detergent or foaming agent, for example. By opening and closing valve 31, the operator of gun 25 controls the flow of additive material, without involving any other moving parts. The outflow through both barrels 26 and 27 is at a lower pressure and higher flow rate than an outflow through single barrel 27. This can produce a flood of washing water and detergent, when valve 31 is open, and a vigorous, high-velocity rinse when valve 31 is closed.

The control of additive materials introduced to the outflow at the secondary input is not limited to washing guns and can be applied wherever a variable fluid flow resistance load is available for exerting the control. Since the secondary inflow automatically responds to varying load resistance, it can be turned on and off simply by changing the load.

We claim:

1. In a hydrokinetic amplifier having a primary liquid input formed into a primary liquid jet surrounded by a motivating vapor that transfers vapor momentum to said primary liquid jet and accelerates said primary liquid jet through a minimum cross-sectional area upstream of a diffuser arranged beyond said minimum cross-sectional area, the improvement comprising:

a. a secondary liquid inlet arranged between said minimum cross-sectional area and said diffuser to merge a secondary liquid with said primary liquid jet in said diffuser;

b. said primary liquid input being drawn from downstream of said diffuser; and c. said secondary liquid enroute to said secondary liquid inlet being arranged to cool said primary liquid input.

2. The improvement of claim 1 wherein the pressure and volume product of the combined primary and secondary liquid flows in said diffuser is larger than the pressure and volume product of said primary liquid jet through said minimum cross-sectional flow area.

3. The improvement of claim 1 including a sensor for the temperature of the output from said diffuser, and a control valve responsive to said sensor for controlling inflow into said secondary inlet.

4. In a hydrokinetic amplifier having a primary liquid input formed into a primary liquid jet surrounded by a motivating vapor that transfers vapor momentum to said primary liquid jet and accelerates said primary liquid jet through a minimum cross-sectional area, the improvement comprising:

a. a secondary fluid inlet arranged beyond said minimum cross-sectional area to merge a secondary fluid with said primary liquid jet in a diffuser arranged beyond said secondary fluid inlet;

b. a load with a variable resistance to fluid flow, said load being arranged to receive the output from said diffuser so that without varying the inflow rates of said primary liquid jet and said motivating vapor, and without varying the flow rate of said primary liquid jet through said minimum cross-sectional area, the outflow rate from said diffuser to said load varies inversely with said fluid flow resistance of said load; and c. the product of the pressure and volume of the combined primary and secondary flows in said diffuser exceeds the product of the pressure and volume of said primary liquid jet through said minimum cross-sectional area.

5. The improvement of claim 4 wherein said primary liquid input is drawn from downstream of said diffuser.

6. The improvement of claim 5 including a heat exchanger in which said primary liquid input is cooled by said secondary liquid enroute to said secondary liquid inlet.

7. The improvement of claim 4 wherein said secondary flow stops and said primary liquid jet continues when said load operates at a high value of said fluid flow resistance.

8. The improvement of claim 7 wherein said secondary flow exceeds the rate of said primary liquid jet when said load operates at a low value of said fluid flow resistance.

9. The improvement of claim 4 wherein said secondary fluid is a liquid having a higher temperature than said primary liquid jet.

10. The improvement of claim 4 wherein said secondary fluid is a liquid containing an additive, and the rate of inflow of said additive into said secondary fluid inlet is controlled by said fluid flow resistance of said load.

11. The improvement of claim 4 wherein said secondary fluid is a vapor that accelerates said primary liquid jet into said diffuser where velocity converts to pressure, which condenses said secondary fluid vapor.

12. The improvement of claim 4 including a sensor for the temperature of the output from said diffuser and a control valve responsive to said sensor for controlling inflow into said secondary inlet.

13. A method of operating a hydrokinetic amplifier to supply fluid to a load that varies its resistance to fluid flow, said hydrokinetic amplifier having a primary liquid input formed into a primary liquid jet surrounded by a motivating vapor that transfers vapor momentum to said primary liquid jet and accelerates said primary liquid jet through a minimum cross-sectional area upstream of a diffuser arranged beyond said minimum cross-sectional area, said method comprising:

a. admitting a secondary fluid to merge with said primary liquid jet in a region beyond said minimum cross-sectional area, so that said secondary fluid flow and said primary liquid jet combine and proceed into said diffuser; and b. varying said fluid flow resistance of said load, without varying the flow rate of said primary liquid jet through said minimum cross-sectional area, so that change in said fluid flow resistance of said load inversely varies both the rate of inflow of said secondary fluid and also the rate of outflow from said diffuser to said load.

14. The method of claim 13 including arranging said secondary fluid to add a material to said primary liquid jet, and admitting said material to said load by operating said load at a flow resistance sufficiently low to allow said secondary fluid to flow, and excluding said material from said load by operating said load at a flow resistance sufficiently high to stop said secondary fluid flow.

15. The method of claim 14 including using a double-barreled gun as said load, allowing fluid flow through only a single barrel of said gun to accomplish said high fluid flow resistance, and allowing fluid flow through both barrels of said on to accomplish said low, fluid flow resistance.

16. The method of claim 13 wherein the pressure and volume product of the combined primary and secondary flows in said diffuser exceeds the pressure and volume product of said primary liquid jet through said minimum cross-sectional area.

17. The method of claim 13 including drawing liquid for said primary liquid input from downstream of said diffuser.

18. The method of claim 17 including using said secondary fluid for cooling said primary liquid input before merging said secondary fluid with said primary liquid jet.

19. The method of claim 13 wherein said secondary fluid is a vapor that accelerates said primary liquid jet into said diffuser where velocity converts to pressure, which condenses said secondary fluid vapor.

20. The method of claim 13 including sensing the output temperature from said diffuser and controlling said secondary fluid flow in response to the sensed temperature.

21. The method of claim 13 wherein said secondary fluid is a liquid having a higher temperature than said primary liquid jet.

22. The method of claim 13 including varying said fluid flow resistance of said load without varying an inflow rate of said motivating vapor.

23. The method of claim 13 including varying said fluid flow resistance of said load without varying the rate of flow of said primary liquid input.

* * * * *